US008327482B2

(12) United States Patent
Awerbuch et al.

(10) Patent No.: US 8,327,482 B2
(45) Date of Patent: Dec. 11, 2012

(54) TWO-PIECE LIGHTWEIGHT LITTER SYSTEM

(75) Inventors: Jonathan Awerbuch, Media, PA (US); Ryan A. Baum, Watertown, NY (US); Timothy A. Hampson, Philadelphia, PA (US); Kevin N. Kline, Southampton, PA (US); Benjamin A. Klopp, Cleveland, TN (US); Kate C. Zinsky, Haddonfield, NJ (US)

(73) Assignee: Drexel University, Philadelphia, PA (US)

( * ) Notice: Subject to any disclaimer, the term of this patent is extended or adjusted under 35 U.S.C. 154(b) by 0 days.

(21) Appl. No.: 13/345,083

(22) Filed: Jan. 6, 2012

(65) Prior Publication Data

US 2012/0102651 A1 May 3, 2012

Related U.S. Application Data

(62) Division of application No. 12/130,000, filed on May 30, 2008, now Pat. No. 8,104,124.

(60) Provisional application No. 60/940,923, filed on May 30, 2007.

(51) Int. Cl.
*A61G 1/013* (2006.01)

(52) U.S. Cl. ..... 5/627; 5/625; 5/626; 5/114; 5/116

(58) Field of Classification Search ..... 5/625–629, 5/110, 111, 112, 114, 116, 117; 403/105
See application file for complete search history.

(56) References Cited

U.S. PATENT DOCUMENTS

| | | | | | |
|---|---|---|---|---|---|
| 1,129,089 | A * | 2/1915 | Hajas | 5/627 |
| 2,396,931 | A * | 3/1946 | Schmid | 5/627 |
| 3,161,395 | A * | 12/1964 | Carter | 248/354.7 |
| 3,417,412 | A | 12/1968 | Andrews | |
| 3,597,773 | A * | 8/1971 | Firestone | 5/627 |
| 3,881,334 | A * | 5/1975 | Wilson | 70/457 |
| 3,886,606 | A | 6/1975 | Bradford | |
| 4,670,921 | A * | 6/1987 | Avni et al. | 5/627 |
| 4,685,161 | A * | 8/1987 | Zalman | 5/627 |
| 5,598,592 | A * | 2/1997 | Castellani | 5/627 |
| 5,788,400 | A | 8/1998 | Wey | |
| 6,842,923 | B1 * | 1/2005 | Castellani et al. | 5/627 |
| 2004/0010852 | A1 * | 1/2004 | Bourgraf, Jr. | 5/627 |
| 2005/0210589 | A1 * | 9/2005 | Dimentmen | 5/627 |

OTHER PUBLICATIONS

North American Rescue Products Inc., "Talon II Model 90C", http://www.narescue.com, May 29, 2007.

North American Rescue Productis Inc., "Stingray Poleless Litter", http://www.narescue.com, May 29, 2007.

North American Rescue Productis Inc., "Talon II Assault Litter Carrier", http://www.narescue.com, May 29, 2007.

North American Rescue Productis Inc., "Raven Model 90C", http://www.narescue.com, May 29, 2007.

* cited by examiner

*Primary Examiner* — William Kelleher
(74) *Attorney, Agent, or Firm* — Mendelsohn, Drucker & Associates, P.C.

(57) ABSTRACT

This invention is directed to a durable, compact, two-piece, light weight, load sustaining litter system for the transport of humans, animals or objects. The litter system comprises a litter frame, a fabric disposed between the structure of the frame, at least one hinge and at least one coupling mechanism. The litter system may be quickly assembled under adverse conditions and may be particularly beneficial in transporting individuals who are injured, disabled and/or incapable of movement under combat and/or emergency conditions.

20 Claims, 13 Drawing Sheets

TWO-PIECE LIGHTWEIGHT LITTER SYSTEM

BACKGROUND OF THE INVENTION

1. Field of the Invention

This invention is directed to a compact two-piece collapsible litter system capable of rapid assembly for transport of humans, animals or objects. The invention may be particularly applicable for use in transporting individuals who are injured, disabled and/or incapable of movement under combat and/or emergency conditions.

2. Description of the Related Technology

During combat, medical treatment facilities are typically located in a secure area separate from the battlefield. To receive medical care, the injured and wounded must be transported from the battlefield using conventional military issued litters. The survival and recovery of these individuals significantly depends upon extraction time; therefore it is desirable to design a litter that can be easily carried and quickly assembled under combat conditions to facilitate the extraction process and enable patients to more quickly obtain medical treatment.

Current U.S. military issued litter systems are heavy, bulky, often difficult to assemble and can be a substantial liability to the extraction process. These litter systems typically remain on transport vehicles during field exercises because of their prohibitive large weight and size. Therefore, litters are often not readily available to the military unit while on combat missions. Therefore, there exists a need to design a litter system capable of enabling more rapid extractions by designing a light weight, durable, load sustaining, compact, easily assembled, two-piece litter system to more effectively evacuate individuals who are injured in combat and/or emergency situations. Also, since two soldiers are required to carry a fully-assembled, loaded litter, it is possible to allow two soldiers to each carry a piece of the litter, when collapsed/dissembled.

SUMMARY OF THE INVENTION

This invention relates to a two-piece litter system. The litter system comprises a frame, a fabric disposed on the frame, and at least two couplers which allow the frame to be divided into two parts.

DETAILED DESCRIPTION OF THE PREFERRED EMBODIMENTS

The present invention is directed to a two-piece litter. The two-piece litter may be durable, lightweight, load-bearing and compact. The litter can be used as a stretcher to facilitate the manual transport of an individual, animal or object, particularly for transport of wounded persons. Typically, such litters are carried by two persons, one at each end, and such litters may be adapted for transport in specially adapted vehicles such as ambulances, trucks, planes and helicopters for safe, fast transport of wounded persons.

Figure 1:
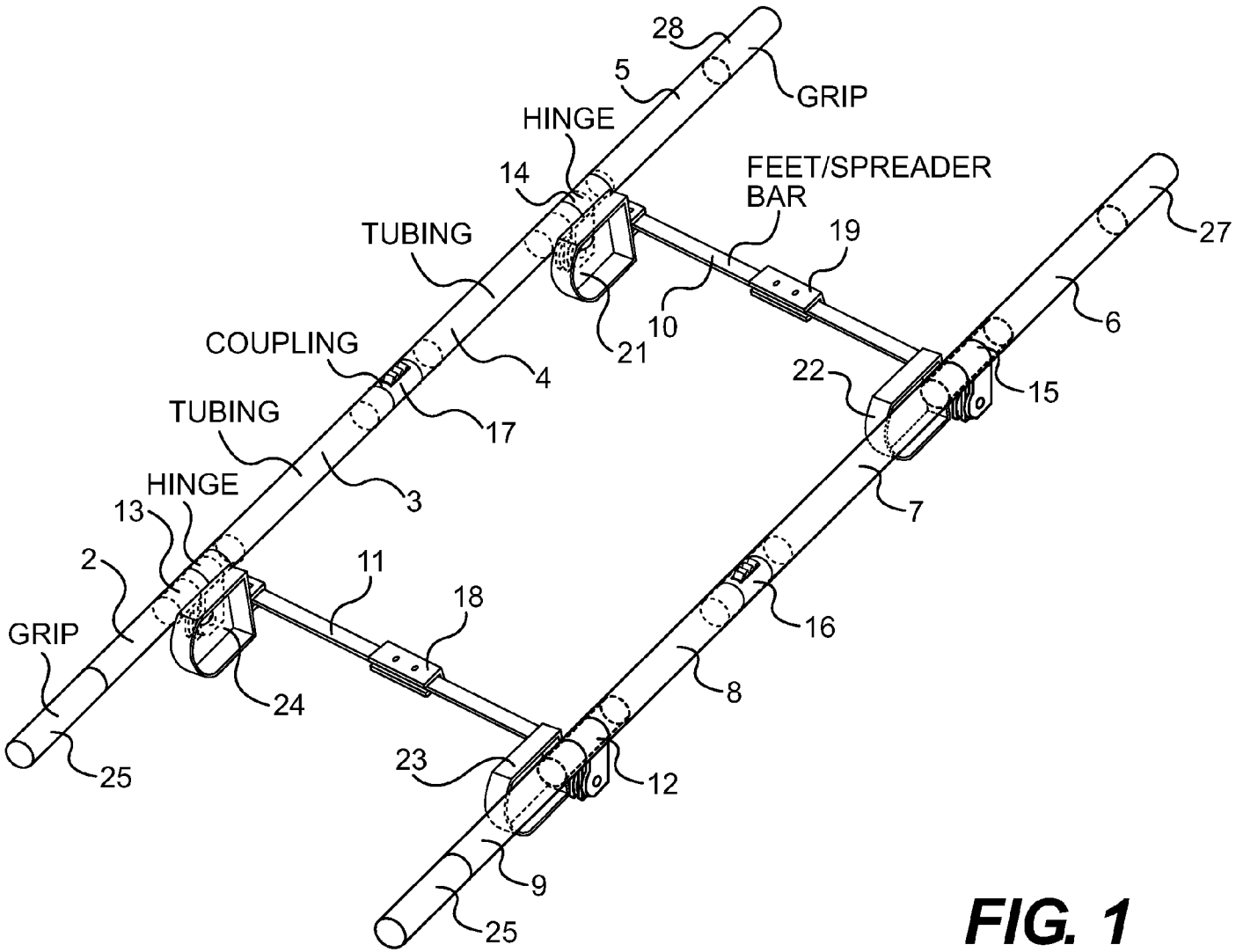
FIG. 1 is an elevation of a two-piece litter system in accordance with the present invention.

As shown in the embodiment of FIG. 1, the litter includes a fabric (not shown) disposed on a frame 1 formed by eight pieces of tubing 2-9, a pair of spreader bars 10 and 11, four hinges 12, 13, 14 and 15 and two couplers 16 and 17. The fabric may be disposed on frame 1 in any suitable conventional manner except that the fabric should be divided into two pieces at the location of couplers 16 and 17 to allow frame 1 to be divided into two separate parts, as discussed below. Optionally, litter 1 may be fitted with four feet 21, 22, 23 and 24. Spreader bars 10, 11 each include lockable hinges 18 and 19.

Figure 18:
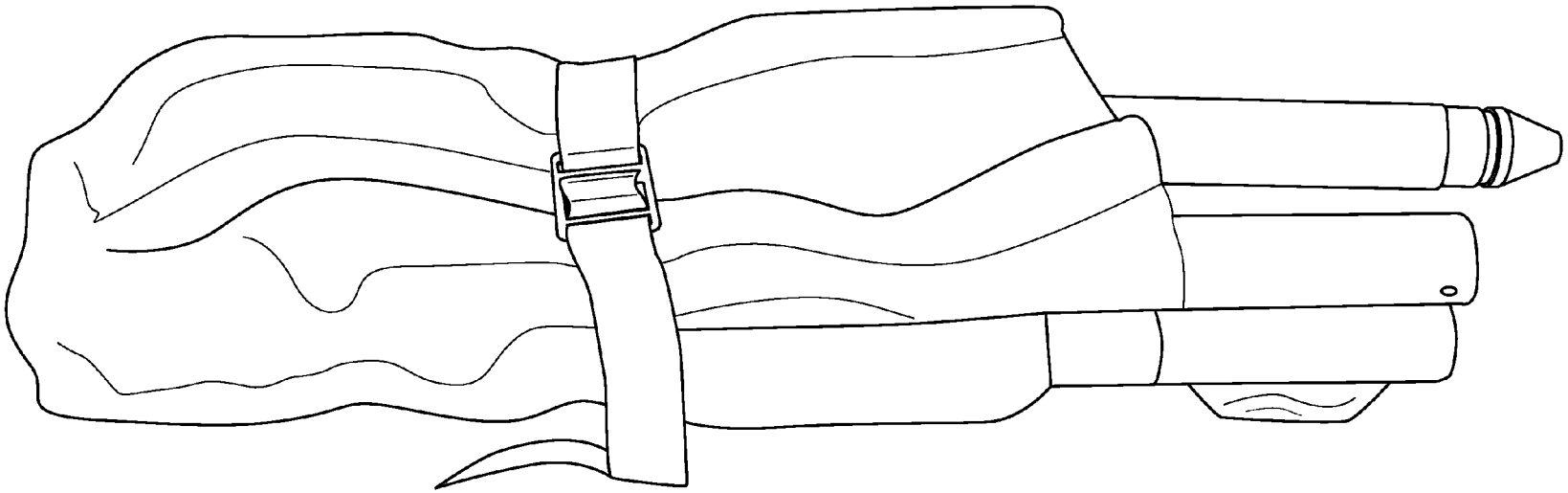
FIG. 18 shows one embodiment of the litter system in a collapsed position.
Figure 19:
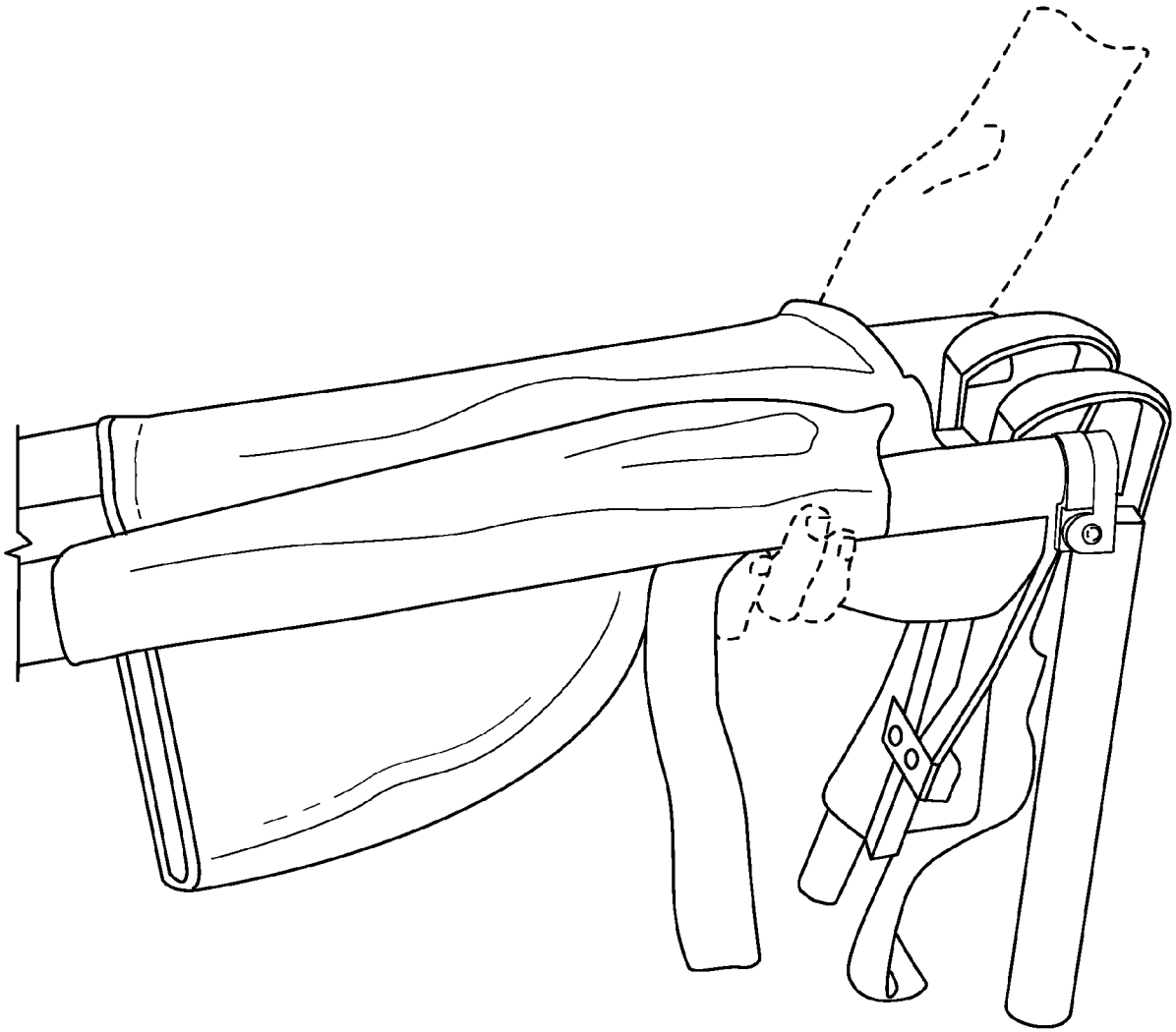
FIG. 19 shows one embodiment of the litter system in which the litter is folded at its hinge.

In operation, hinges 12, 13, 14 and 15 may be disengaged to allow frame 1 to fold at each of the locations of hinges 12, 13, 14 and 15. In addition, spreader bars 9, 10 can also fold at the locations of hinges 18 and 19. Frame 1 may include hand grips 25, 26, 27 and 28. Finally, frame 1 can be divided into two parts by splitting frame 1 at the location of couplers 16 and 17. This allows frame 1 to be split into two parts, each of which parts can be folded up to a relatively small size, as shown in FIGS. 18-19.

Frame 1 may be composed of any durable, high strength and lightweight material, having a suitable thickness and structural strength to bear the type of load that may be encountered in normal use of the litter. Preferably, the litter is capable of supporting a payload of at least about 500 lbs.

Figure 17:
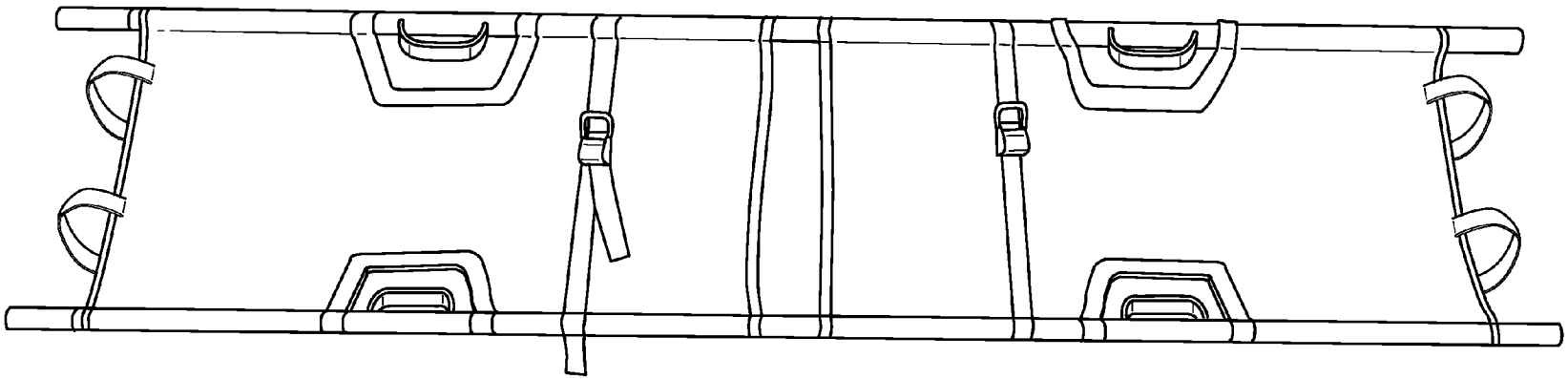
FIG. 17 is a side view of one embodiment with the fabric disposed between the litter frame.

At least two pieces of fabric are disposed on frame 1, as shown in FIG. 17. The fabric may be constructed from any durable, lightweight, high strength material capable of supporting at least about 500 pounds and capable of withstanding instantaneous loading, ripping, tearing or any other applied stress. In a preferred embodiment, the fabric is composed of cotton, flame and water resistant cotton, polyurethane coated nylon, vinyl laminated nylon, vinyl coated polyester or a mixture thereof; more preferably, the fabric is composed of a light weight, non-skid, flame-retardant monofilament polymer material. Most preferably, the fabric is constructed from the same a lightweight, non-skid, flame-retardant monofilament polymer material such as that used in the North American Rescue Products™ Stingray® Poleless Litter, which features a slip resistant surface that is resistant to mildew, washable and meets civilian and fire safety codes. Furthermore, the Stingray® fabric is approximately 78 inches by 24 inches and weighs only 1.5 pounds.

Tubing 2-9 may be composed of aluminum, such as AL 2024, AL 6061, AL 7075 aluminum alloys, or mixtures thereof. Alternatively, steel, composite materials or other alloys may be employed. Table 1 discloses the material properties of AL 2024, AL 6061, and AL 7075. Each of the various components of frame 1 may also be constructed from suitable materials which may be the same or different from the material used for tubing 2-9, depending on such factors as mechanical strength, machining capability, cost, weight, etc.

TABLE 1

| Aluminum | Density (×1000 kg/m$^3$) | Tensile Stress (MPa) | Shear Stress (MPa) | Cost ($ per sq. ft.) |
|---|---|---|---|---|
| 2024 | 2.77 | 185 | 125 | 23.05 |
| 6061 | 2.7 | 115 | 83 | 5.33 |
| 7075 | 2.8 | 220 | 150 | 22.90 |

Tubing 2-9 may be configured to have any structural form or cross-sectional shape sufficient to support a payload of at least about 500 lbs and capable of accommodating hinges and couplers, as discussed below. Tubing 2-9 may have a uniform cross-section, which may be circular and may have an outside diameter of up to about 5 centimeters, optionally, up to about 4 centimeters. Smaller diameters may also be possible, depending on the type of material and wall thickness employed. One suitable wall thickness is about 0.35 cm. The tubing cross-section may also be, for example, rectangular, "C" channel, etc., or combinations thereof to allow for additional variations in the device such as smaller folding dimensions and reduced weight.

In another embodiment, only two hinges and two couplers are provided in which case only six tubular portions would be employed. This embodiment would potentially be applicable to smaller litters or to litters that do not fold as small as the embodiment described above.

In one embodiment, tubing 2-9, or portions thereof, may be filled with a buoyant, material such as a firm, lightweight foam insulation, capable of rendering the litter at least partially buoyant in water. The buoyancy of the litter would facilitate flotation of the litter on a body of water when manual transport over water is required.

Figure 16:
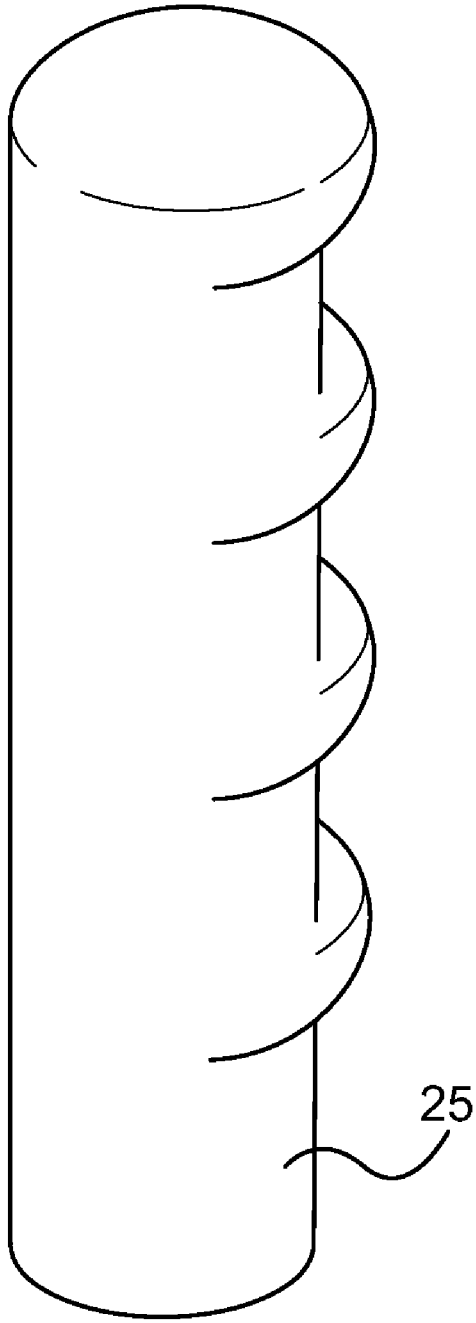
FIG. 16 is a perspective view of one embodiment of a hand grip useful in the present invention.

At least four portions of tubing 2-9 include hand grips 25, 26, 27 and 28 to facilitate carrying the litter. The hand grips 25-28 may be made from any suitable material, including a polymeric material, and may be designed in any suitable configuration to facilitate gripping. In a preferred embodiment, the hand grip has an ergonomic design that conforms to the contours of an individual's hand, as shown, for example, in FIG. 16.

Frame 1 includes four hinges 12-15 as shown in FIG. 1. The hinges 12-15 may be any suitable hinge capable of permitting folding of a portion of frame 1 for efficient storage. Hinges 12-15 may lock in the position shown in FIG. 1 to provide structural integrity to frame 1 when used for carrying a load. Hinges 12-15 may be constructed from any suitable material, preferably a lightweight, high strength, durable, corrosion-resistant material such as aluminum or steel is employed. Preferably, the hinge 15 has a limited number of movable parts to minimize obstruction by contaminants, such as dirt, from the surrounding environment which may compromise the operability of the litter and to avoid the addition of unnecessary weight.

Figure 2:
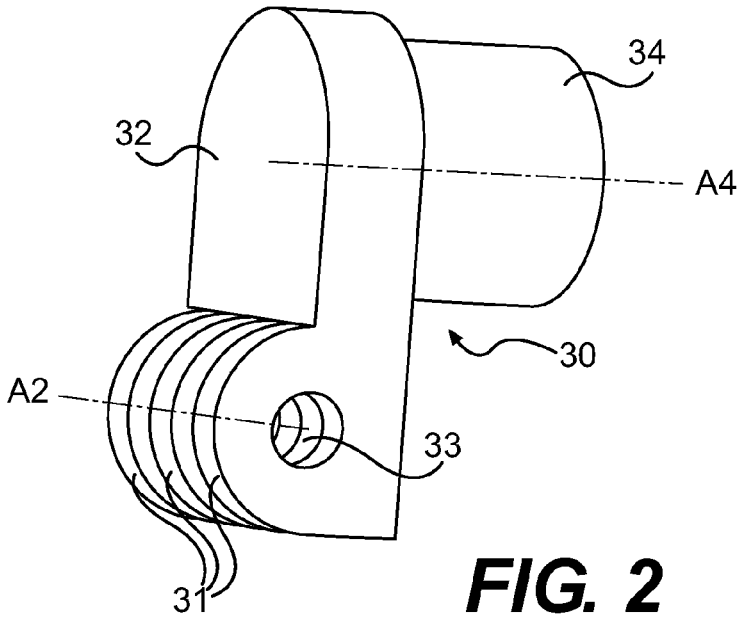
FIG. 2 is a perspective view of a portion of a hinge of the present invention.
Figure 3:
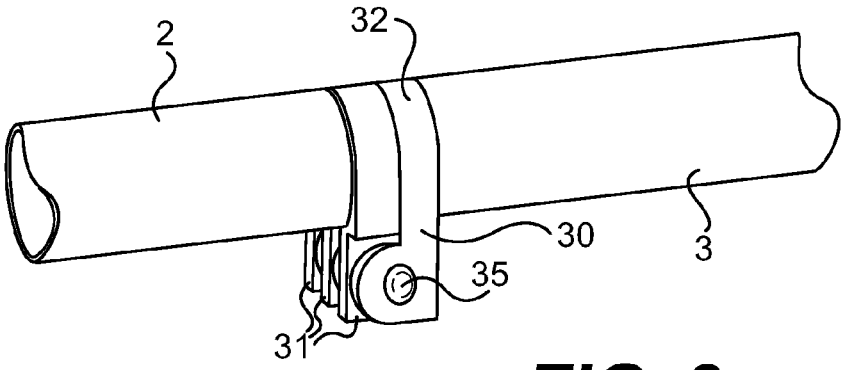
FIG. 3 is a perspective view of a portion of the frame of the litter system showing the hinged connection.

One embodiment of a hinge 12-15 is shown in FIG. 2. The hinge may be formed from two identical hinge components 30, each having a set of teeth 31. In this case, hinge component 30 includes three teeth. The hinge also includes a mating surface 32, a hole 33 and a connector 34. In use, the connector 34 of each hinge component 30 is fitted within a tubular section 2-9 of frame 1 to connect hinge component 30 to a tubular section 2-9 of frame 1. Connector 34 may be inserted into tubular sections 2-9 of frame 1 using a press-fit, friction-fit or snap-fit, as desired. FIG. 3 shows connectors 34 press-fitted into tubular sections 2, 3 of frame 1.

Two tubular sections 2-9 are connected by inserting teeth 31 of one hinge component between teeth 31 of a second hinge component 30 and locating a pin 35, shown in FIG. 3, in holes 33 through teeth 31 of hinge components 30 to fasten hinge components 30 together. Pin 35 allows rotation of teeth 31 of hinge components 30 about pin 35, for example, by having a smooth, cylindrical outer surface, in order to allow hinge components 30 to pivot about the longitudinal axis of pin 35. In this manner, adjacent tubular sections 2-9 of frame 1 can be folded at an angle of up to 180 degrees in order to fold tubular sections to half of their original size for storage.

Mating surfaces 32 are adapted to abut against one another when hinge components 30 are in the position shown in FIG. 3 to allow full extension of tubular sections 2, 3 shown in FIG. 3 to form a rigid frame 1 when it is desired for the litter to bear a load. A separate locking mechanism, shown in FIGS. 7-8 may be provided to lock hinge components in the position shown in FIG. 3 to provide additional structural integrity to frame 1 for load bearing.

Figure 4:
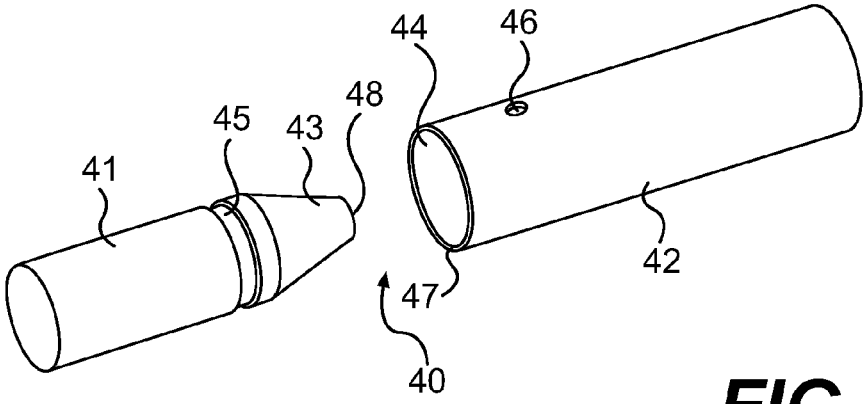
FIG. 4 is a perspective view of a portion of the frame provided with a first embodiment of a coupler in accordance with the present invention.
Figure 5:
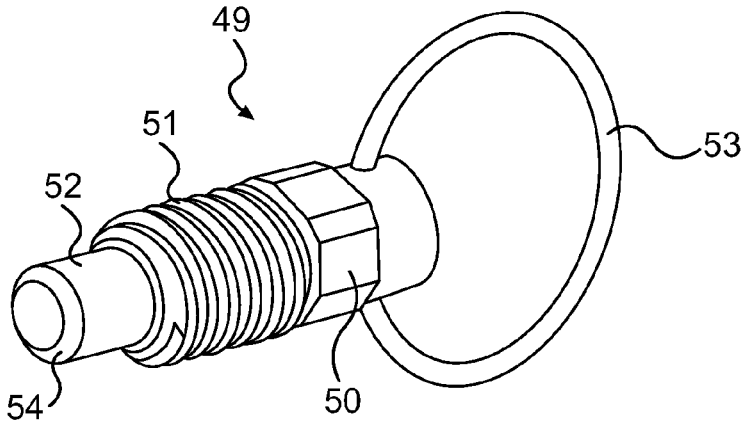
FIG. 5 is a perspective view of a locking pin for use with the coupler shown in FIG. 4.

The two parts or sections of frame 1 may be quickly assembled using couplers 16, 17. One embodiment of a coupler 40 is shown in FIG. 4. Coupler 40 includes a male portion 41 and a female portion 42. Male portion 41 is provided with a tapered portion 43 adapted for insertion into orifice 44 in female portion 42. At a trailing edge of tapered portion 43 is a provided a groove 45 which may extend part or all the way around the perimeter of male portion 41. Female portion 42 includes a hole 46 through one wall thereof in which a coupling pin 49, shown in FIG. 5, is located. Hole 46 is positioned at a distance from leading edge 47 of female portion 42 that the center of groove 45 is positioned from leading edge 48 of male portion 41 such that groove 45 is aligned with hole 46 when male portion 41 is inserted to the maximum extent desired into female portion 42. At that point, coupling pin 49 locks male portion 41 into female portion 42.

As shown in FIG. 5, coupling pin includes three salient parts, a grip 50, a spring 51 and a tip 52 which is attached to grip 50 via spring 51. Grip 50 may include a ring 53 to facilitate pulling on grip 50 when it is desired to release male portion 41 from female portion 42. In operation, tapered portion 43 of male portion 41 first engages beveled surface 54 of tip 52 of pin 49 and forces tip 52 to move upwardly and ride up along the surface of tapered portion 43 to allow tapered portion 43 to past pin 49 in female portion 42. Once male portion 41 is inserted a sufficient distance into female portion 42, tip 52 will drop into groove 45 of male portion 41 as a result of the force exerted on tip 52 by spring 51 of pin 49. This locks male portion 41 into female portion 42. When it is desired to release male portion 41 from female portion 42, one pulls on ring 53 to retract tip 52 a sufficient distance to clear groove 45 and allow removal of male portion 41 from female portion 42.

Figure 20:
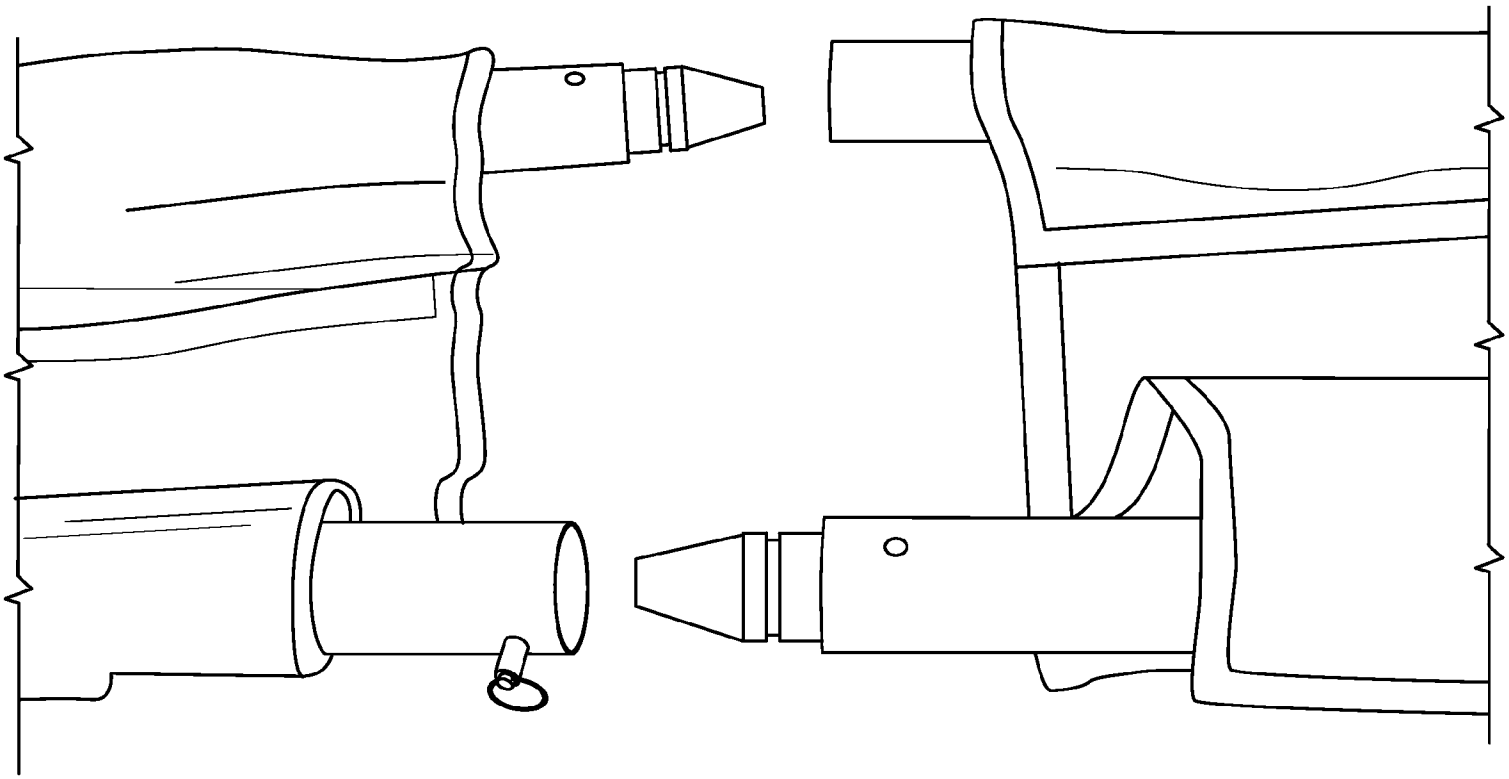
FIG. 20 shows a male and female coupling on each piece of the litter system.

Coupler 40 is capable of uniting the two portions of frame 1 together in a very short time period of only a few seconds. One advantage of this coupling system is that each of the two portions of frame 1 has both a male and female coupling component and thus each portion of frame 1 is therefore identical, as shown in FIG. 20. As a result, any two portions of frame 1 will fit together. This universal concept may be vital to soldiers because one never knows what could happen in warfare and mixing and matching the two pieces would otherwise be possible throughout a squad of soldiers. In addition, significant advantages are realized in manufacturing since a single set of parts can be employed to provide both portions of frame 1.

Figure 6:
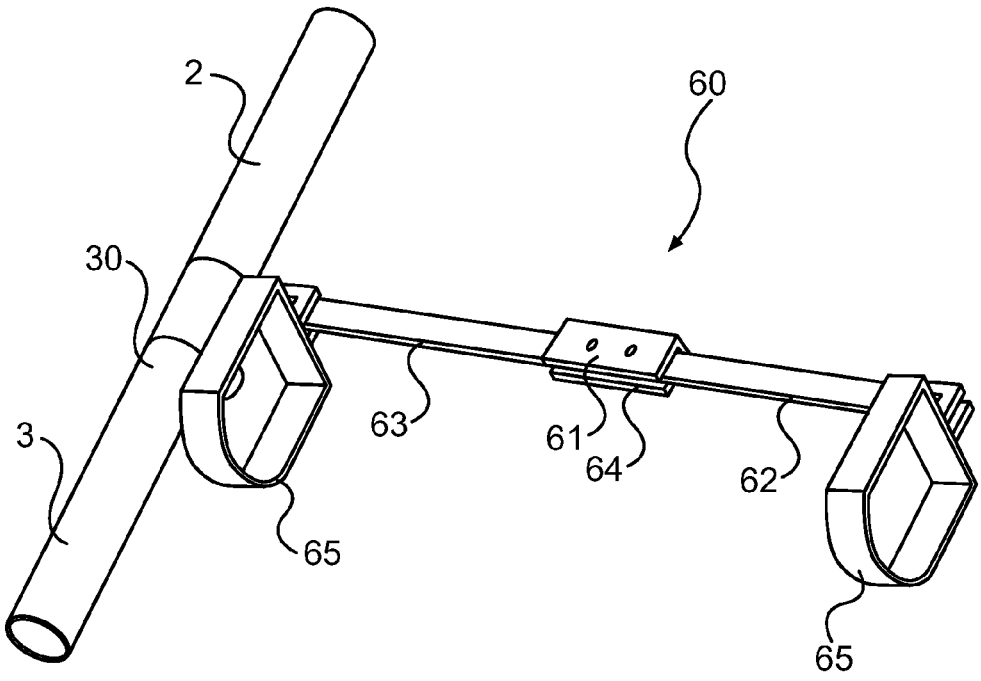
FIG. 6 is perspective view of a spreader bar shown attached to a hinged portion of the frame.

Each portion of frame 1 includes at least one spreader bar 10, 11 which may be extended, as shown in FIG. 6, to establish the rigid frame 1. Spreader bars 10, 11 typically include three movable components. As shown in FIG. 6, spreader bar 60 includes a hinge 61, and two bar sections 62, 63. Below hinge 61 is a foot grip 64 which may be used to quickly deploy spreader bar 60 and lock spreader bar 60 in place with a swift kick. To collapse spreader bar 60, spreader bar 60 must be pulled outwards toward the handles of the litter. In a preferred embodiment, the spreader bar 9 has the same standard dimensions as that of conventional spreader bars compatible with military vehicle carousel units and military helicopters, such as the UH-60 Black Hawk Helicopter. One example of a suitable spreader bar may be found on a Raven 90™ litter system. Also shown in FIG. 6, are feet 65 located on frame 1.

Frame 1 further includes four feet 21-24 which may be attached to spreader bars 10, 11 at appropriate locations. It is preferable to attach feet 21-24 to spreader bars 10, 11 by means of a conventional pin attachment, not shown, at attachment point 73 so that feet 21-24 do not interfere with the ability of the spreader bars 10, 11 to fold and collapse the litter. Feet 21-24 are capable of balancing frame 1 and capable of withstanding a payload of at least 500 pounds. By attaching feet 21-24 to spreader bars 10, 11 as opposed to tubing 2-9, it is possible to simplify the manufacturing process.

Figure 7:
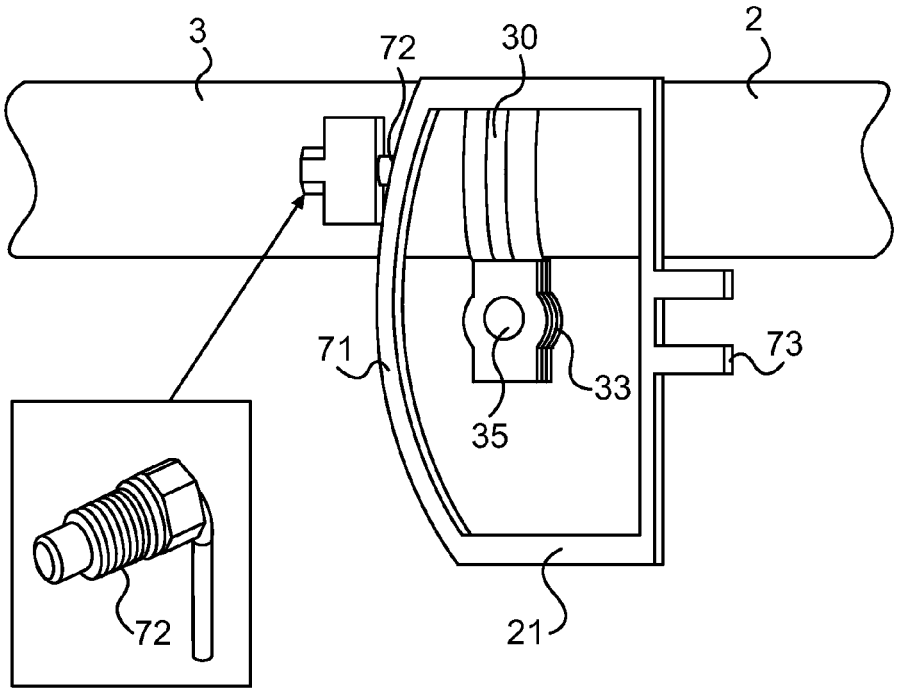
FIG. 7 is a perspective view of a portion of the frame showing the foot, the hinge and hinge locking mechanism, with the locking pin shown in an inset.
Figure 8:
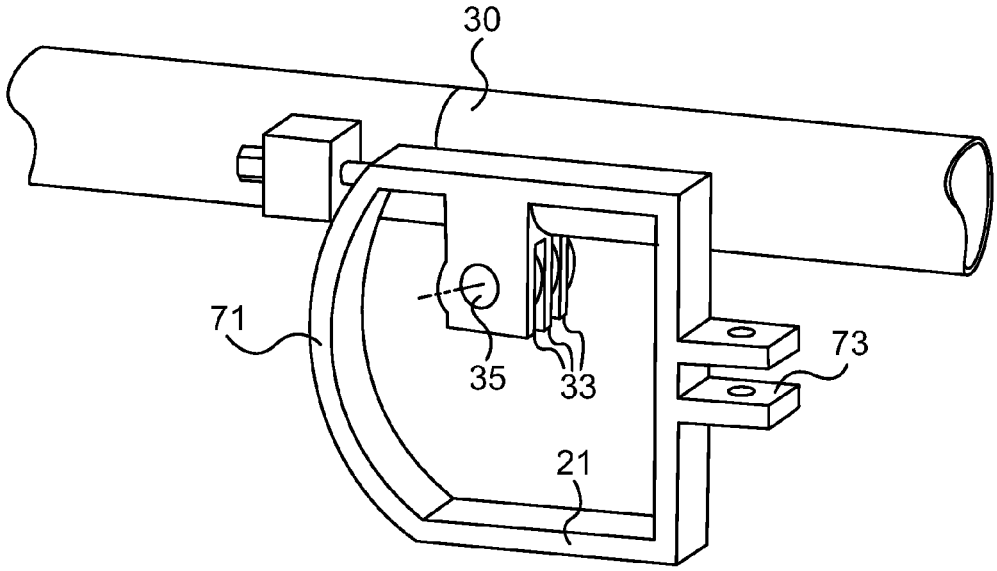
FIG. 8 is another perspective view of the frame, foot, hinge and hinge locking mechanism shown in FIG. 7.

As shown in FIGS. 7-8, feet 21-24 may also include a mechanism for locking hinge 30 into place to form a rigid frame 1. The locking mechanism is formed by a combination of a leading surface 71 of feet 21-24 which is provided with a hole (not shown) into which a hinge locking pin 72 engages when hinges 30 is in the position whereby frame 1 is fully extended, as shown in FIGS. 7-8. During extension of frame 1, pin 72 rides along leading surface 71 of feet 21-24 until it reaches the hole (not shown) in leading surface 71 and engages. To unlock hinge 30, pin 72 is retracted from the hole by pulling on grip 89, which may optionally include a ring. Once pin 72 is retracted from the hole in hinges 30, tubular sections 2, 3 can be pulled apart and folded. Feet 21-24 are attached to spreader bars 10, 11 at attachment point 73.

Figure 9:
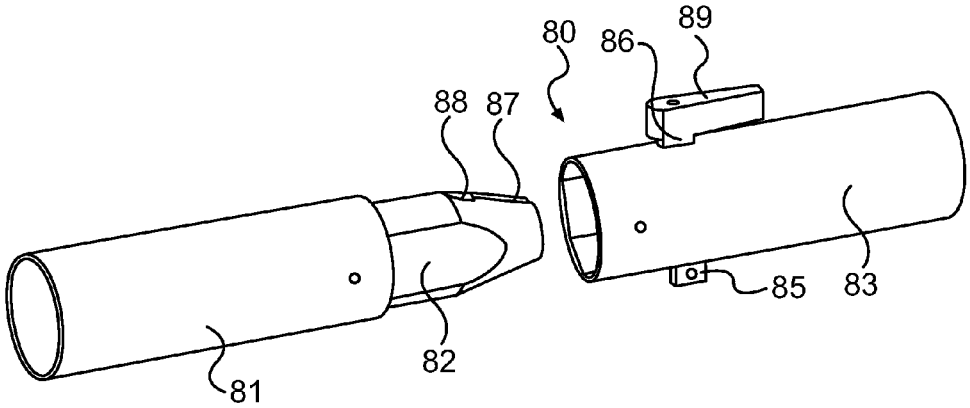
FIG. 9 is a perspective view of a portion of the frame provided with a second embodiment of a coupler in accordance with the present invention.
Figure 10:
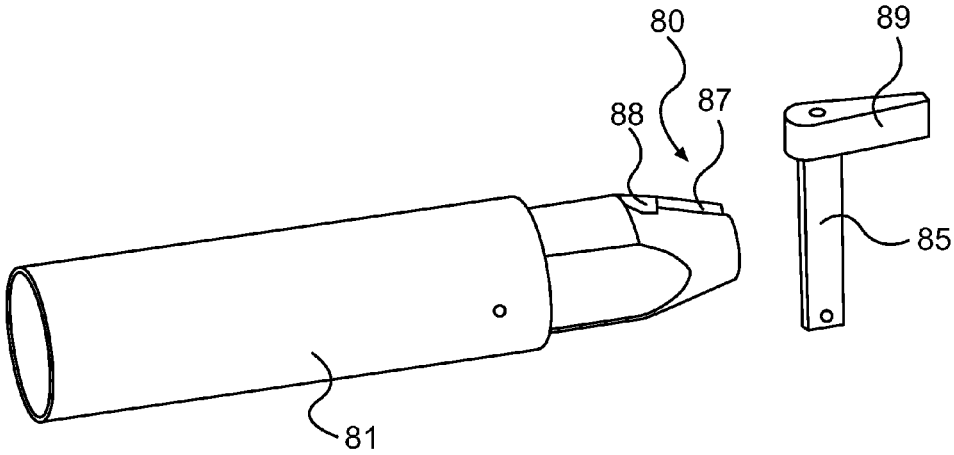
FIG. 10 is a perspective view of the male portion of the coupler of FIG. 9, as well as the coupling pin used in the coupler of FIG. 9.
Figure 11:
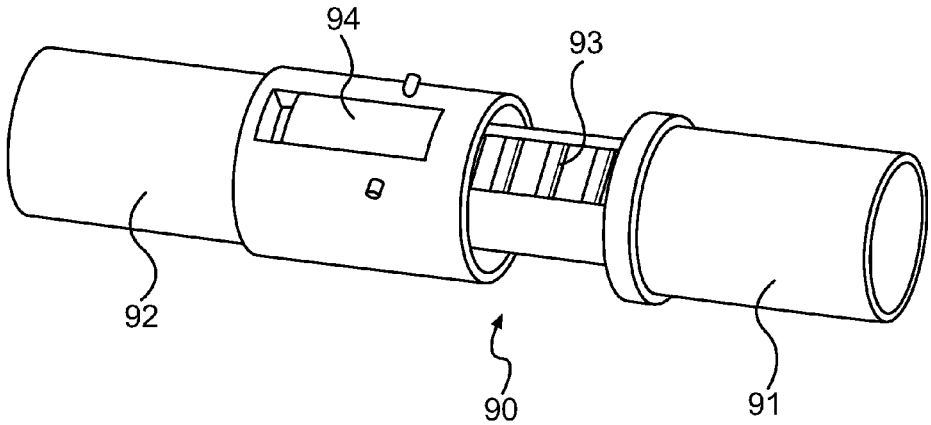
FIG. 11 is a perspective view of a portion of the frame provided with a third embodiment of a coupler in accordance with the present invention.
Figure 12:
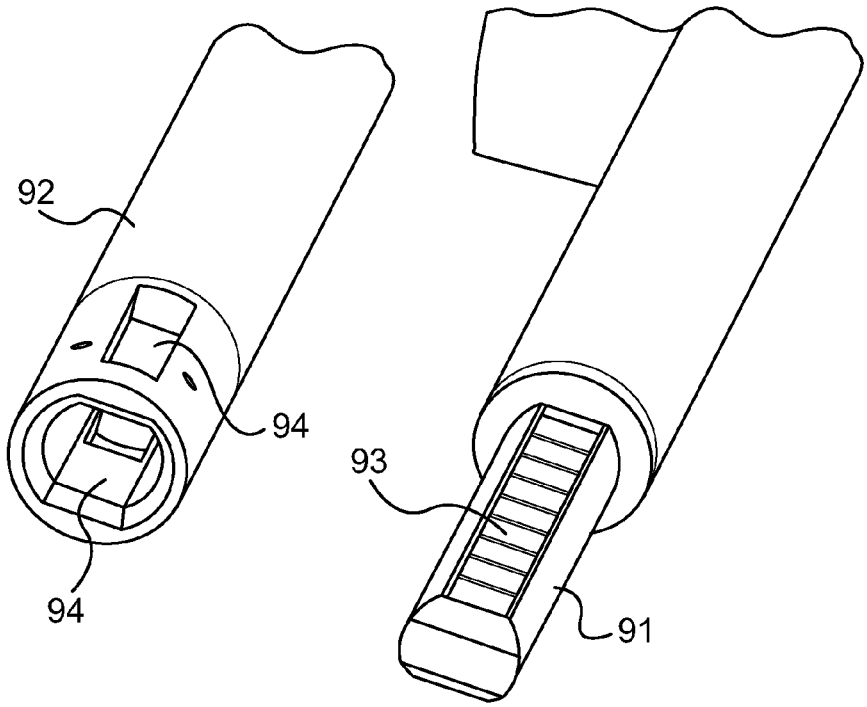
FIG. 12 is another perspective view of the male and female portions of the coupler of FIG. 11.
Figure 13:
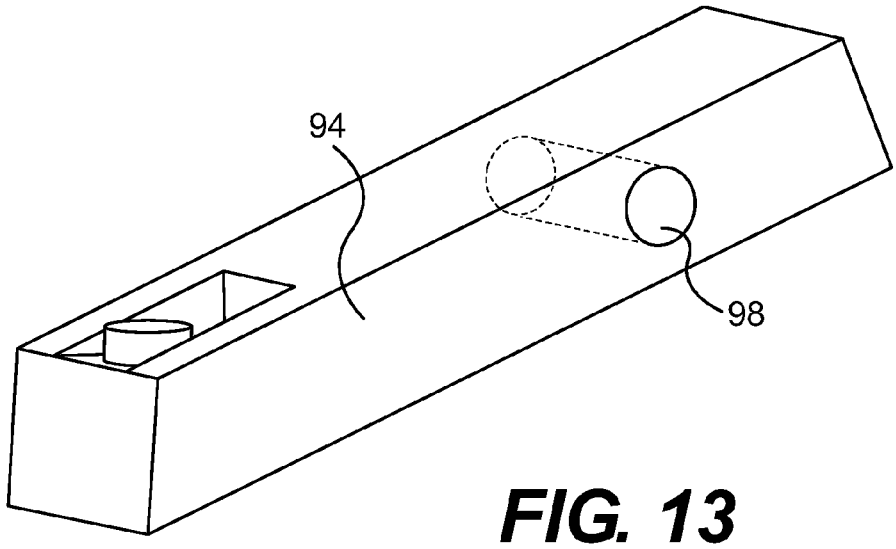
FIG. 13 is a perspective view of the button of the ratchet coupling.

In another embodiment, the coupling mechanism is a vertical pin coupling design 80, as shown in FIGS. 9-10. The vertical pin coupling comprises a male component 81, having a tapered protrusion 82 that may be inserted within a female component 83 having an opening 84 that conforms in shape to tapered protrusion 82 to provide alignment of the male and female components 81 and 83. A vertical pin 85 is inserted into a hole 86 through female component 83 as shown in FIG. 9. Tapered protrusion 82 includes a slot 87 and a hole 88 therethrough. When tapered protrusion 82 is inserted into female component 83, vertical pin 85 slides through slot 87 until it is located in hole 88. At that point, vertical pin 85 can be turned 90 degrees to lock the coupling since vertical pin 85 has a rectangular cross-section which, when turned, will no longer able to pass through slot 87 in tapered protrusion 82 of male component 81. This coupling design may be self-locking by provision of a cam surface to cause automatic rotation of vertical pin 85 upon insertion of male component 81 into female component 83. Also, the design of tapered portion 82 provides self-guided insertion, and the disassembly of the male and female parts is uncomplicated since vertical pin 85 need only be manually rotated 90 degrees by gripping pin grip 89 to disengage male component 81 from female component 83.

Figure 14:
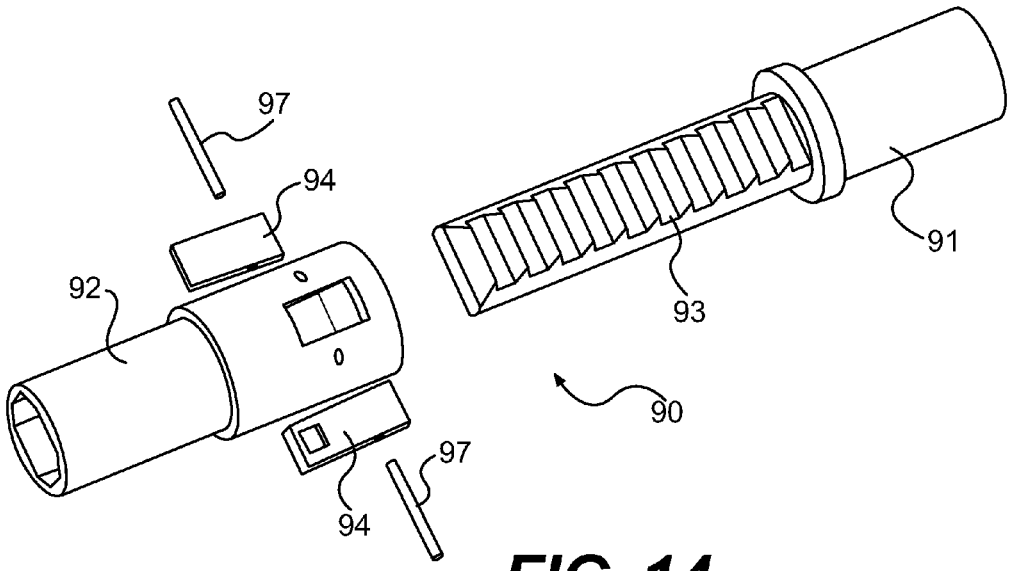
FIG. 14 shows the complete ratchet coupling assembly.
Figure 15:
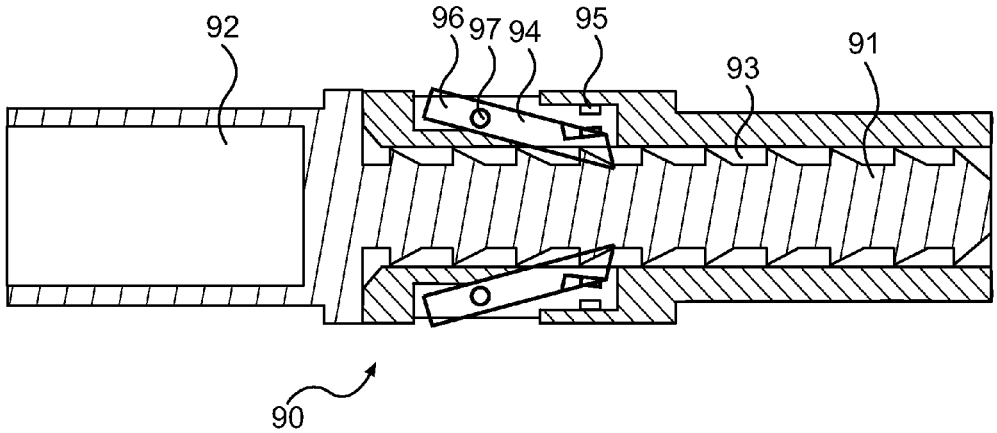
FIG. 15 is a perspective view of the complete ratchet coupling assembly.

In another embodiment, the coupler is a ratchet coupler 90, as shown in FIGS. 11-15. The ratchet coupling comprises a male component 91 and a female component 92. Male component 91 is provided with a ridged portion 93 which forms a standard ratchet mechanism together with a claw 94 provided on female component 92. Preferably, each male component 91 includes two ridged portions 93 on either side and each female component 92 includes two claws 94 on either side. Claw 94 is rotatably mounted on a pin 97 located in female component 92 via a hole 98 in claw 94. Claw 94 of female component 92 may be mounted to engage a spring-biased plunger 95, shown in FIG. 15 that may be used to lock and release the coupling. FIG. 14 demonstrates how the male and female coupling components 91, 93 are located within the tubing of the frame 1. When the end 96 of claw 94 is depressed, claw 94 is released from ridged portion 93. When the coupling is in place, an audible "click" confirms that the frame 1 is properly assembled and ready for use. To disassemble the ratchet coupling, the user may press on an end 96 of spring-biased plunger 95 to disengage claw 94 from ridged portions 93 while pulling the male component 91 away from the female component 93.

Rather than fitting couplers within tubular sections one or both parts of the couplers may be formed integrally as part of the end of one or more tubular sections, if desired.

Frame 1, as well as other parts, may be made from, coated with or provided with an outer layer of hydrophobic material to reduce the likelihood that dirt or debris will adhere to frame 1 or any parts thereof. In one embodiment, at least all of the interacting parts of the couplers include a hydrophobic outer layer. Also, coatings, layers or surfaces of, for example, polytetrafluoroethylene or other non-stick or reduced friction material may be provided to facility assembly and disassembly of the parts of frame 1.

Figure 21:
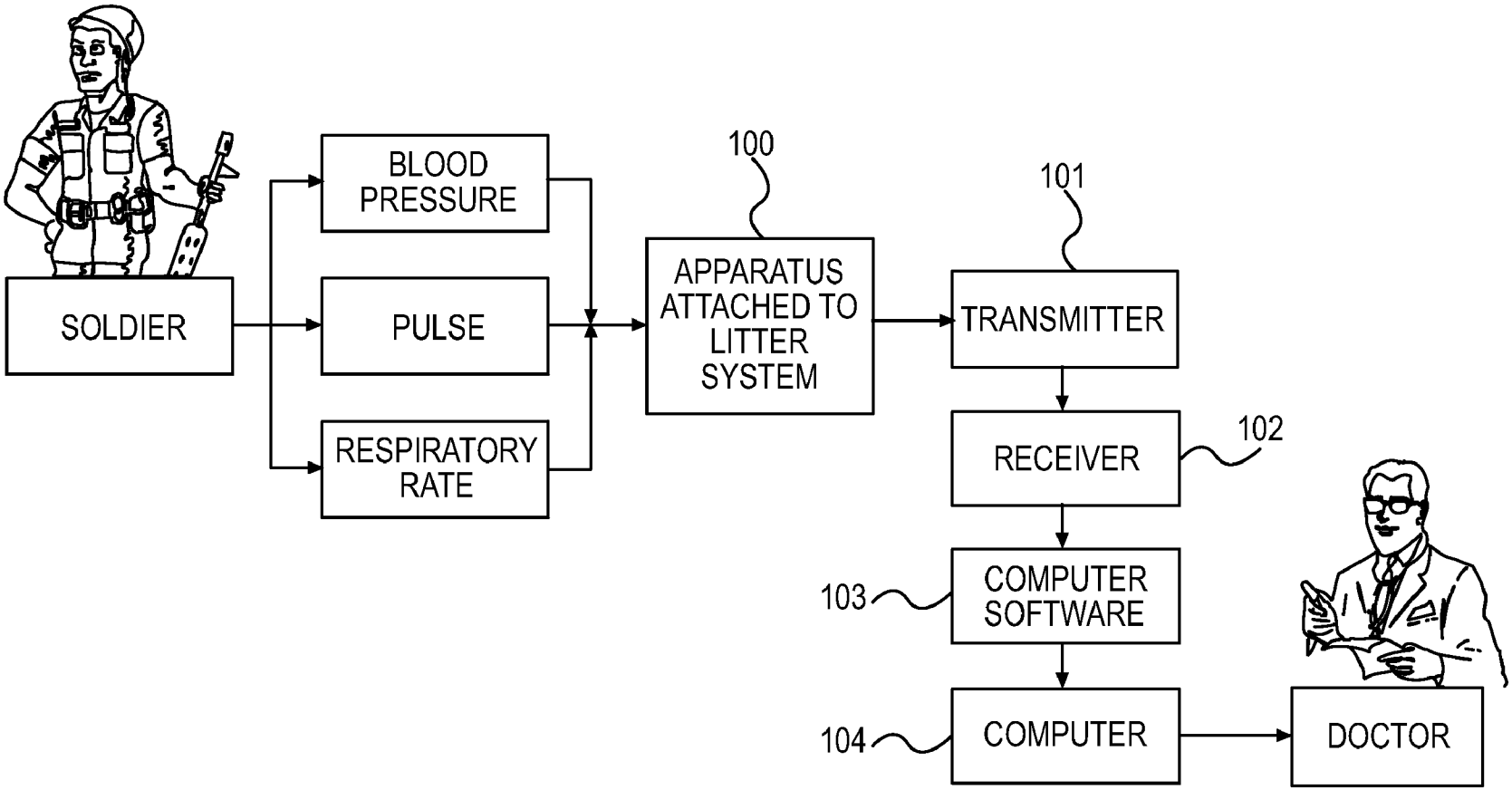
FIG. 21 shows a schematic diagram of a diagnostic system using the two-piece litter system of the present invention.

Optionally, frame 1 may further incorporate a diagnostic means 100 for sensing and recording various vital signs, such as blood pressure, heart rate/pulse, respiratory/oscillatory rate and temperature, of an individual being transported on a litter system including the frame 1. In a preferred embodiment, the diagnostic means 100 is capable of measuring at least blood pressure, pulse and respiratory rate, and the diagnostic means 100 is capable of being initiated in less than about 3 sec. The recorded data may be wirelessly transmitted to a designated medical facility in real time, to facilitate diagnosis and increase a patient's chances of survival and/or recovery. FIG. 21 provides a schematic of the diagnostic system comprising a diagnostic means 100, attached to a frame 1, capable of sending a patient's vital sign to a transmitter 101, which in turn is sent to a receiver 102. This receiver 102 is capable being hooked up to a data analysis system 104, i.e. such as through a USB port. This data analysis system 104 will run through computer software 103.

A prime consideration was to maintain current dimensions of designs on the market (22.5"×7"×6"). Every component of the litter must function every time in all environmental conditions when folded to its compact state to being extended into its rigid state. A unique locking mechanism provided using the feet of the litter. Based on the dimensions and the locations of the hinges, the spreader bar feet and the hinge/locking mechanism were incorporated together into one piece of the litter. This simplicity of design makes manufacturing easier and minimizes the movable parts of the design. The spring pin used to lock the hinge is manufactured by McMaster Carr, and is merely used to hold one-half of the litter in the outstretched position to aid in the process of connecting the two halves together. This pin is not designed to hold the weight of a casualty. Due to the position of the hinges, however, the tubes will bear the majority of this load where they meet at the hinge. Although the tolerances are tight, these small clearances are vital to ensuring the litter remains compact during storage.

The durable, compact, two-piece, light weight, load sustaining litter system of the present invention has a number of advantageous design features that is a significant improvement over the prior art litter assemblies. The overall size and weight of the litter system has been reduced, enabling two individuals to carry the two-piece litter system atop their backpacks. The litter system may be folded at its hinges for efficient compact storage. Additionally, by carrying the litter system as two separate pieces, a litter bearer's load is automatically reduced by 50%. In a preferred embodiment, the over all weight of the system is less than about 20 lbs, more preferably less than about 15 lbs and most preferably less than about 10 lbs. The overall weight of the litter system is significantly dependent upon the tubing structure. Lighter litter systems may be fabricated by reducing tubing diameter and/or wall thickness and by selecting different construction materials. Table 2 shows possible weight reductions by changing the outer diameter and wall thickness of tubing.

TABLE 2

AL6061 Tubing Weight Reduction Alternatives

| | Current Model | Smaller OD Tubing | Thinner Wall Tubing | Smaller OD and Thinner Wall Tubing |
|---|---|---|---|---|
| Outer Diameter (in) | 1.50 | 1.25 | 1.50 | 1.25 |
| Inner Diameter (in) | 1.25 | 1.00 | 1.375 | 1.1375 |
| Total Length (in) | 88.00 | 88.00 | 88.00 | 88.00 |
| Density (lb/in^3) | 0.098 | 0.098 | 0.098 | 0.098 |
| Total Weight (lbs.) | 4.66 | 3.81 | 2.43 | 1.82 |
| Weight Difference | N/A | 0.85 | 2.22 | 2.84 |
| % Weight Savings | N/A | 18.18 | 47.73 | 60.93 |

The litter system is furthermore structurally durable, reliable, and capable of sustaining a payload of at least 500 lbs in the most extreme combat environments. The design is capable of withstanding interaction between the litter system and environmental factors such as dirt, immersion in water, and other excipients that may cause corrosion and wear. The present invention is particularly designed to accommodate assembly under combat conditions by limiting the number of movable parts in the invention and thereby minimizing exposure of the hinges and coupling mechanism to dust, dirt or sand, which could impede and compromise the proper operation of the litter system.

The litter system is also advantageously designed to be quickly assembled under combat or emergency conditions within less than about 30 seconds, more preferably less than about 15 seconds and most preferably less than about 10 seconds.

Additionally, the litter system is inexpensive and may be easily manufactured. The litter system utilizes symmetrical components enabling interchangeability and reduce specialized manufacturing needs.

The litter system of the present invention is therefore an affordable, easily manufactured, durable, light weight, compact, two-piece alternative to conventional litter systems that can be quickly assembled under combat or emergency conditions. The litter system was designed to be simply operated and collapsible without losing structural integrity and compatibility of sustaining a minimum payload capacity of about 500 lbs. The litter system may be used to transport any individual, animal, or object. The present invention may be particularly beneficial for transporting individuals who are injured, disabled and/or incapable of movement.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. For example, other couplers or hinges known to persons skilled in the art may be employed in the litters of the present invention. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A litter comprising:

a frame formed in two parts;

at least two pieces of fabric for supporting an object to be carried on the litter, at least one piece of fabric being disposed on each part of the frame in a manner which allows the frame to be removably separated into two parts without removing the fabric from the frame; and at least two couplers associated with said frame for releasably coupling the two parts of the frame together to form the litter, said couplers permitting the two part of the frame to be repeatedly separated from and reconnected to one another, wherein each of the two parts of the frame comprises two frame portions spaced apart from one another and connected by a bar, wherein the bar comprises a hinge and a grip positioned below the hinge for deploying the bar, wherein each frame portion comprises a first frame member and a second frame member connected by a hinge to allow folding of said frame portions to a folded position, and wherein each said bar connects the first frame members of each said part of the frame.

2. The litter of claim 1, wherein the at least two couplers are adapted to permit quick separation and connection of the two parts of the frame.

3. The litter of claim 1, wherein the litter is adapted to be assembled from said two parts in less than about 30 seconds.

4. The litter of claim 1, wherein each part of the frame further comprises at least two hinges which allow said parts of the frame to fold to present a smaller maximum dimension.

5. The litter of claim 4, wherein each part of the frame comprises at least three hinges which allow said parts of the frame to fold to present a smaller maximum dimension.

6. The litter of claim 4, wherein each said hinge comprises two identical hinge components.

7. The litter of claim 6, wherein each of the hinge components includes a mating surface, wherein the mating surface of each hinge component abuts against the mating surface of another of said hinge components when said frame is in an unfolded position and wherein said hinge comprises a locking means for locking said hinge when said frame is in an unfolded position.

8. The litter of claim 7, wherein each said hinge component is provided with a set of teeth and wherein at least some teeth of one said hinge component fit between teeth of another said hinge component to form said hinge and wherein each of said teeth comprises a hole therethrough and said hinge further comprises a pin inserted through said holes in said teeth to attach said hinge components together and permit rotation of each of said hinge components about said pin through an angle of up to about 180 degrees.

9. The litter of claim 7, wherein each hinge further component comprises a protruding member adapted for insertion into an opening in said frame for attaching each said hinge component to said frame.

10. The litter of claim 9, wherein said hinges attach to said frame by one of a press-fit, friction-fit or snap-fit.

11. The litter of claim 1, wherein each said part of the frame is identical.

12. The litter of claim 1, wherein each coupler comprises a male portion and a female portion.

13. The litter of claim 12, wherein each part of said frame is attached to one male portion of one said coupler at one location and one female portion of another said coupler at another location, whereby each part of said frame is interchangeable.

14. The litter of claim 12, wherein said male portion is tapered to facilitate insertion of said male portion of said coupler into said female portion of said coupler.

15. The litter of claim 12, wherein said coupler comprises a vertical pin, said male portion is provided with a tapered protrusion adapted for insertion into an opening in said female component that conforms in shape to said tapered protrusion in order to align the male and female portions, and said female portion includes a hole through which said vertical pin may be inserted and said tapered protrusion of said male portion includes a slot in which said vertical pin rides during insertion of said male portion into said female portion and a hole in which said vertical pin is located when said male portion is fully inserted into said female portion.

16. The litter of claim 15, wherein said vertical pin has an asymmetric structure which, when turned ninety degrees, will no longer be able to pass through the slot in the tapered protrusion of the male portion of the coupler.

17. The litter as claimed in claim 14, wherein said coupler further comprises a coupling pin, said female portion includes a hole in one wall thereof which hole is adapted for insertion of said coupling pin, said male portion includes a groove in an outer surface thereof which aligns with said coupling pin when said male and female portions are coupled together and said coupling pin is inserted through said hole in said female portion.

18. The litter as claimed in claim 17, wherein said coupling pin comprises a grip, a spring and a tip attached to said grip by said spring, said tip being sized to fit into said groove in said male portion of said coupler.

19. The litter as claimed in claim 18, wherein said tip of said coupling pin comprises a beveled surface adapted to engage and ride along said tapered portion of said male portion during insertion of said male portion into said female portion.

20. The litter as claimed in claim 12, wherein the male portion comprises a ridged area and said female portion comprises a claw which forms a ratchet mechanism together with said ridged area of said male portion and wherein said claw is mounted to engage a spring-biased plunger to lock and release the coupler.

* * * * *